US008864491B1

(12) United States Patent
Pfefferle et al.

(10) Patent No.: US 8,864,491 B1
(45) Date of Patent: Oct. 21, 2014

(54) DIRECT INJECTION METHOD AND APPARATUS FOR LOW NOX COMBUSTION OF HIGH HYDROGEN FUELS

(75) Inventors: William C. Pfefferle, Madison, CT (US); Benjamin D. Baird, Rocky Hill, CT (US); Shahrokh Etemad, Trumbull, CT (US); Sandeep K. Alavandi, Hamden, CT (US)

(73) Assignee: Precision Combustion, Inc., North Haven, CT (US)

( * ) Notice: Subject to any disclaimer, the term of this patent is extended or adjusted under 35 U.S.C. 154(b) by 1678 days.

(21) Appl. No.: 12/001,931

(22) Filed: Dec. 12, 2007

(51) Int. Cl.
*F23M 3/04* (2006.01)

(52) U.S. Cl.
USPC ..... 431/10

(58) Field of Classification Search
CPC ..... F23C 13/00; F23C 13/06; F23C 6/045; F23C 6/047; F23C 7/00
USPC ..... 431/10, 9, 7, 268, 11, 354; 48/198.7, 48/127.7; 1/10; 110/345; 417/187; 422/654; 429/434, 466; 60/299
See application file for complete search history.

(56) References Cited

U.S. PATENT DOCUMENTS

| | | | | | |
|---|---|---|---|---|---|
| 2,763,322 | A | * | 9/1956 | Eichelman | 251/117 |
| 3,796,207 | A | * | 3/1974 | Olson | 123/142.5 R |
| 3,826,078 | A | * | 7/1974 | Quigg | 60/776 |
| 3,841,278 | A | * | 10/1974 | Frehe | 123/41.61 |
| 4,631,024 | A | * | 12/1986 | Shibata et al. | 431/268 |
| 5,174,226 | A | * | 12/1992 | Martin et al. | 110/297 |
| 5,339,635 | A | * | 8/1994 | Iwai et al. | 60/733 |
| 5,517,815 | A | * | 5/1996 | Fujioka et al. | 60/39.12 |
| 5,766,276 | A | * | 6/1998 | Javet et al. | 48/198.7 |
| 5,865,030 | A | * | 2/1999 | Matsuhama | 60/736 |
| 6,358,040 | B1 | * | 3/2002 | Pfefferle et al. | 431/7 |
| 6,394,791 | B2 | | 5/2002 | Smith | |
| 7,444,820 | B2 | * | 11/2008 | Colket, III | 60/777 |
| 8,419,421 | B2 | * | 4/2013 | Hirota et al. | 431/187 |
| 2003/0072708 | A1 | | 4/2003 | Pfefferle | |
| 2005/0201906 | A1 | * | 9/2005 | Alvin et al. | 422/177 |
| 2005/0241313 | A1 | * | 11/2005 | Bruck | 60/723 |
| 2006/0201065 | A1 | * | 9/2006 | Lucas et al. | 48/198.1 |
| 2007/0037105 | A1 | | 2/2007 | Pfefferle | |

OTHER PUBLICATIONS

Etemad, Shahrokh, Lance Smith, and Kevin Burns. United States. US Department of Energy. "System Study of Rich Catalytic/Lean burn (RCL) Catalytic Combustion for Natural gas and Coal-Derived Syngas Combustion Turbines". Morgantown, West Virginia: National Energy Technology Labratory, 2004.*

Ciferno, Jared, and John Marano. United States. Department of Energy. "Benchmarking Biomass Gasification Technologies for Fuels, Chemicals and Hydrogen Production". National Energy Technology Labratory, 2002.*

(Continued)

*Primary Examiner* — Avinash Savani
*Assistant Examiner* — Vivek Shirsat

(57) ABSTRACT

A method for low NOx combustion, without premixing of fuel and air prior to passage to a combustor, is provided wherein a fuel is injected into a reaction zone via an eductor thereby inducing an air flow and producing a fuel-rich mixture. The fuel-rich mixture is reacted and produces partial reaction products plus heat. A portion of the heat is to transferred to a cooling air stream and the cooled partial reaction products are brought into contact with the heated cooling air stream for combustion. Increased injection of the fuel results in an increased induction of the air flow.

18 Claims, 3 Drawing Sheets

(56) References Cited

OTHER PUBLICATIONS

Rollbuhler, James. United States. National Aeronautics and Space Administration (NASA).“Fuel-Rich, Catalytic Reaction Expirimental Results (NASA Technical Memorandum 104423)”. Lewis Research Center, 1991.*

European Search Report, European patent application 08171501 (corresponding to U.S. Appl. No. 12/001,931), transmitted to Applicants Jan. 22, 2014; 1 page.

* cited by examiner

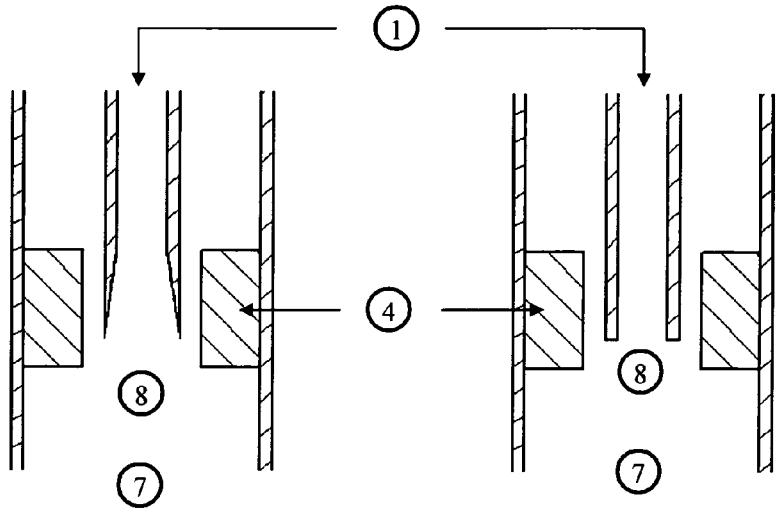
Fig. 2
Fig. 3
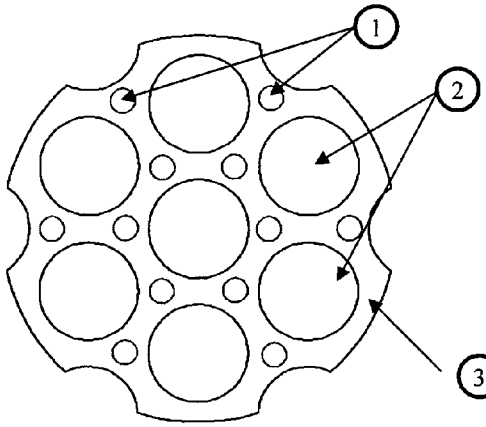
Fig. 4A
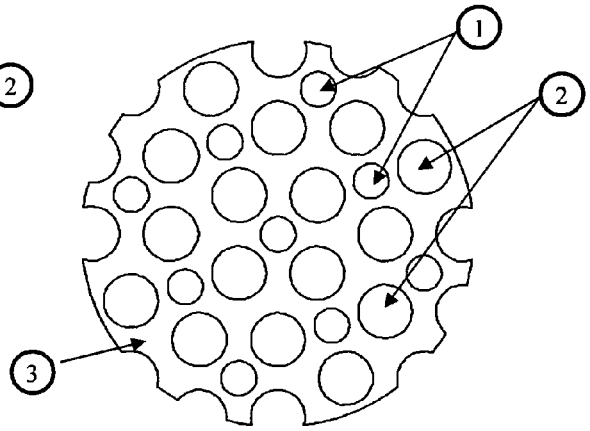
Fig. 4B

DIRECT INJECTION METHOD AND APPARATUS FOR LOW NOX COMBUSTION OF HIGH HYDROGEN FUELS

GOVERNMENT RIGHTS

This invention was made with government support under U.S. Contract No. DE-FC26-05NT42647. The U.S. government holds certain rights in this invention

FIELD OF THE INVENTION

The present invention relates to a method for ultra-low NOx combustion of fuels, even high hydrogen and low BTU content gases, including, without limitation, syngas, gasified coal, and natural gas. The present invention provides a method for separately supplying fuel and air to a reactor for in-situ mixing and reaction prior to combustion with additional air.

BACKGROUND OF THE INVENTION

With energy usage directly related to economic growth, there has been a steady increase in the need for increased energy supplies. In the U.S., coal is abundant and comparatively low in cost. Unfortunately, conventional coal-fired steam power plants, which are a major source of electrical power, are inefficient and pollute the air. Thus, there is a pressing need for cleaner, more efficient coal-fired power plants. Accordingly, Integrated Gasification Combined Cycle ("IGCC") coal technology systems have been developed which can achieve significantly improved efficiencies in comparison to conventional steam plants. In such a system, syngas (a mixture of hydrogen and carbon monoxide) is produced by partial oxidation of coal or other carbonaceous fuel. This allows cleanup of sulfur and other impurities, including mercury, before combustion.

Concern over global warming resulting from carbon dioxide emissions from human activity, primarily the combustion of fossil fuels, has led to the need to sequester carbon. If carbon dioxide sequestration is desired, the carbon monoxide can be reacted with steam using the water gas shift reaction to form carbon dioxide and hydrogen. Carbon dioxide may then be recovered using conventional technologies known in the art. This allows pre-combustion recovery of carbon dioxide for sequestration. Removal of the carbon dioxide leaves a fuel gas much richer in hydrogen. Unfortunately, there is an issue for low NOx combustion for these high hydrogen fuels.

As a result of the high flame speed of hydrogen, flashback is likely with premixed dry low NOx combustion systems. Flashback remains an issue with the use of syngas as well. Regardless of whether carbon dioxide is recovered or whether air or oxygen are used for syngas production, hydrogen content of the gas typically is too high to allow use of conventional dry low NOx premixed combustion for NOx control. Therefore, diffusion flame combustion is used typically with steam or nitrogen added as a diluent to the syngas from oxygen blown gasifiers to minimize NOx emissions. Even so, exhaust gas cleaning may still be required. Thus, such systems, though cleaner and more efficient, typically cannot achieve present standards for NOx emissions without NOx clean-up methods.

A further problem is that the presence of diluent in the fuel increases mass flow through the turbine often requiring the bleeding off of compressor discharge air to reduce turbine rotor stresses. Since bleed off of compressor air must be limited to allow sufficient air for combustion and turbine cooling, the amount of diluent which can be added to the fuel is limited. Typically, NOx cannot be reduced below about ten parts per million ("ppm") without operational problems, including limited flame stability. There are further efficiency loss issues. If nitrogen is added to dilute the fuel gas, there is an energy penalty related to the need to compress the nitrogen to the pressure required for mixing with the fuel gas. In addition, use of syngas in a gas turbine designed for natural gas increases turbine mass flow even without dilution for NOx reduction. Typically, to avoid excessive loads on the turbine rotor, operation is at a reduced turbine inlet temperature and/or with bleed of compressed air from the turbine compressor. Low BTU gases also have a high content of diluents and may require rotor protection.

It has previously been shown that rich pre-combustion with transfer of reaction heat allows low NOx formation in diffusion flame combustion; for example, as taught in U.S. Publication No. 2007/0037105 (U.S. patent application Ser. No. 11/439,727). Using a reactor such as that described in U.S. Pat. No. 6,394,791, the content of which is incorporated herein, the stoichiometric flame front temperature ("SFFT") of high hydrogen content fuels can be reduced sufficiently to provide ultra-low NOx combustion. Unfortunately, some high hydrogen fuels are difficult to safely premix.

SUMMARY OF THE INVENTION

It has now been found that with a backside cooled reactor, the need for fuel-air premixing can be eliminated for fuels by direct injection of both fuel and air into the catalytic reactor flow channels with in-situ mixing of the fuel and air. As discussed in this invention, fuels include any known fuels such as, for example, natural gas, low BTU content gas, syngas (including coal derived and carbon reduced syngas), hydrogen and the like. Whether or not conditions may provide ignition of the fuel upon contact with air, the reactor is substantially protected having backside cooled walls. Moreover, the fuel flow can be used to inject much more air than would otherwise flow through the available effective open area, thus allowing greater fuel conversion in the reactor and thus greater reduction in the stoichiometric flame front temperature ("SFFT") on contact with the cooling air. By reducing SFFT, NOx is reduced. With a fuel flow air injector, air flow increases with increased fuel flow and decreases with decreased fuel flow, yielding lower part load reactor flame temperatures and thus lower catalyst temperatures. With hydrogen fuels, conditions can readily be chosen to provide reaction of the hydrogen upon contact with the injected air. In this case, no catalyst is needed on the tubes.

As indicated by CFD (Computational Fluid Dynamics) analysis, mixing is very rapid. Experimental in-situ mixing has demonstrated good stability and performance.

BRIEF DESCRIPTION OF THE DRAWINGS

FIG. 2 shows a more detailed view of one embodiment of the in-situ mixer.

FIG. 3 shows a more detailed view of a second embodiment of the in-situ mixer.

FIG. 4 shows a view of a section of two air header plates with catalytic air and cooling air tube entrances.

As shown in FIG. 1, in one embodiment of the present method, air flow to the reactor is split into two paths: a reaction flow path, referred to in this embodiment as a catalytic air path (1), and a cooling air flow path, referred to in this embodiment as a cooling air path (2). The catalytic/cooling air tubes are held in their pattern by a header plate (3). Fuel is distributed throughout the reactor by the fuel distribution plenum (5) formed between the header plate (3) and a fuel distribution plate (4). Fuel is introduced to fuel conversion region, referred to in this embodiment as the catalytic region (7) through gaps (6) in the fuel distribution plate (4) around the catalytic air path (1). With appropriate gap (6) sizing, the fuel will pass through gaps (6) at high velocity which will entrain and rapidly mix air from the catalytic air path (1) with the fuel at location (8). In addition, better mixing is achieved by mixing over many smaller mixers spread over the fuel distribution plate rather than one mixer located upstream. As is well known in the art, eductor effectiveness depends on gap (6) spacing and catalytic air path (1) outlet placement at location (8), but is readily adjusted to meet the reactor needs.

Figure 1:
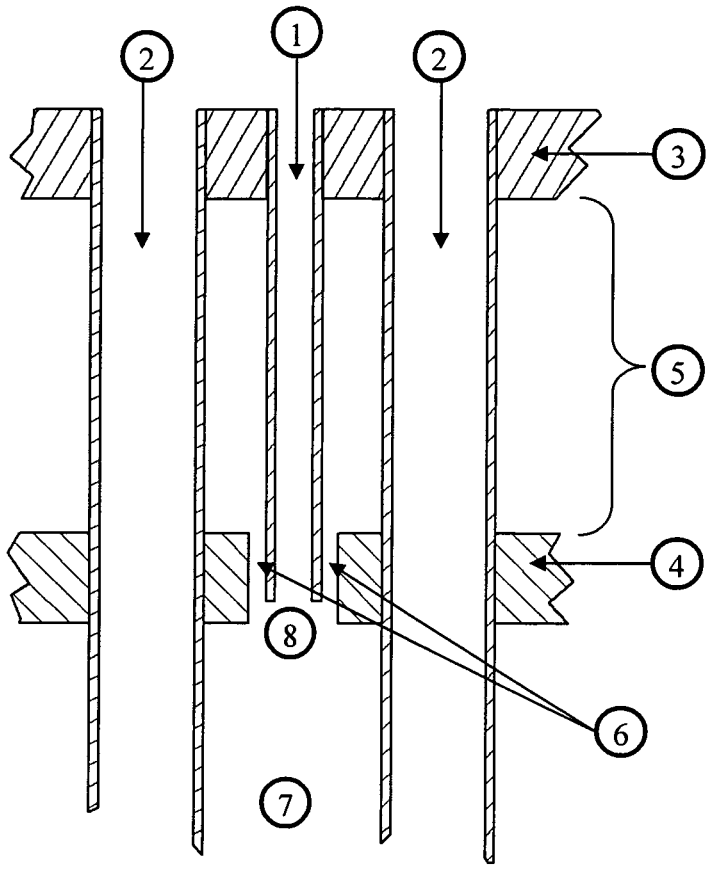
FIG. 1 illustrates the basic configuration of the in-situ mixer.

Although the mixing in the figure occurs in parallel jet stream, other methods typical for premixing such as perpendicular jet penetration, etc. are part of the present invention. In addition, as stated in the Summary of the Invention, with hydrogen fuels, conditions can readily be chosen for use with hydrogen fuels to provide reaction of the hydrogen upon contact with the injected air such that no catalyst is needed on the tubes.

Upon contact between the fuel and air, ignition may occur inside the catalytic channels. Since all surfaces are actively cooled, the reactor is not damaged. For instance, all the catalyst coated elements are cooled internally via cooling air path (2). The fuel distribution plate (4) is backside cooled by the incoming fuel in the chamber of fuel distribution plenum (5). The reactor housing (not shown) has a high thermal mass and may be cooled from an external air flow. This can be provided by having the air flow to the reactor pass over the housing before introduction to the reactor or a separate air stream could provide cooling.

Further, if gas phase combustion does occur within the catalytic channels, it is advantageous due to high conversion of catalytic air from catalytic air path (1) and increase in the transfer of the heat of combustion to the cooling air flow of cooling air path (2). This may lead to lower downstream NOx emissions. Whether or not gas phase ignition occurs, conversion of fuel is promoted by reaction on the catalytic cooling tube walls.

FIGS. 2 and 3 show details of two air injector designs. The tapered/angled tube defining catalytic path air (1) in FIG. 2 provides higher air splits due to enhanced eductor/catalytic air path (1) air interaction. In either case, mixing occurs rapidly.

FIGS. 4A and 4B show sections of two different header plate (3) designs with cooling air path (2) and catalyst air path (1) flow passages. Other design configurations for catalyst and cooling air are considered within the scope of the present invention.

Figure 5:
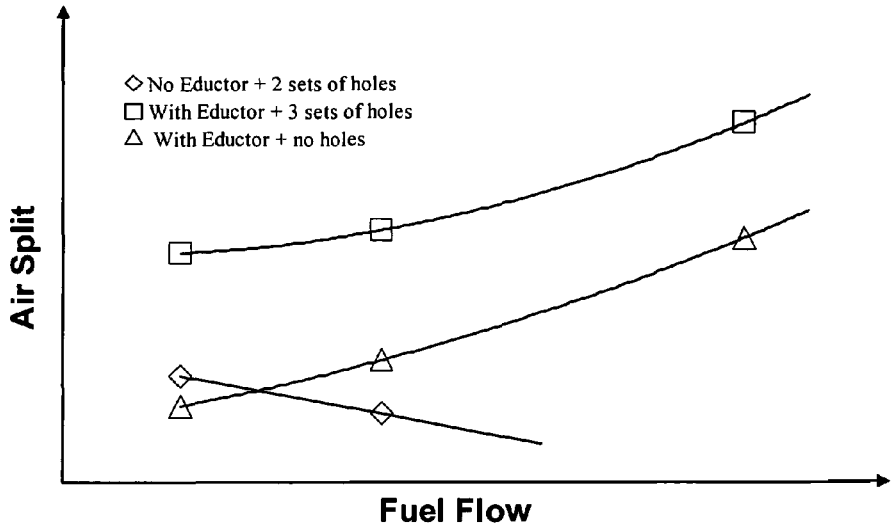
FIG. 5 shows the air splits for three different reactors.

FIG. 5 shows the increased air split possible with the method of the present invention and lower split at lower fuel flow. This allows use of high splits at base load. Further it also causes no increase in catalyst temperatures at part load conditions. The "sets of holes" in the legend refers to holes drilled in the downstream of the catalytic channels intended to increase the effective flow area. However, experiments show that bypass holes are not necessary to achieve a required effective open area.

Figure 6:
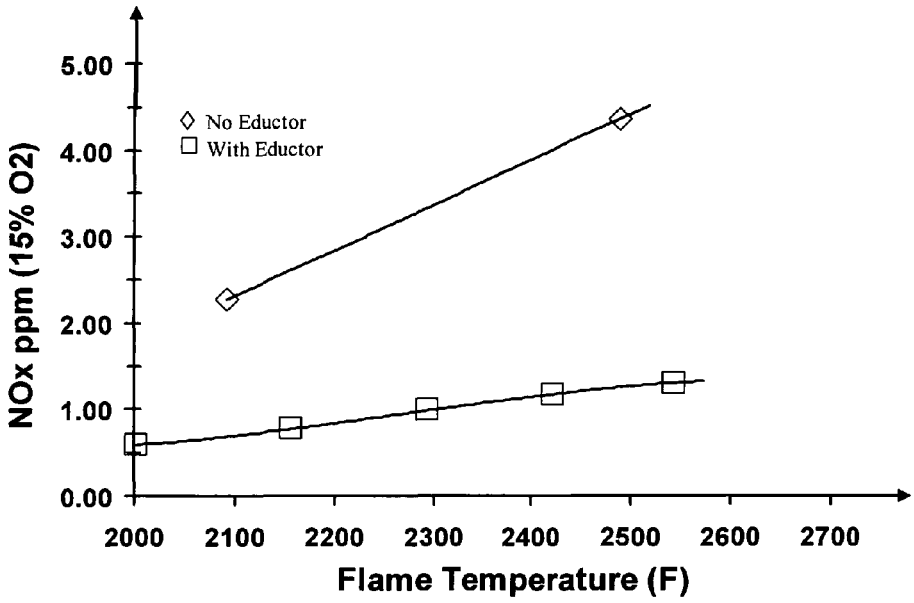
FIG. 6 shows the difference in NOx emissions between eductor and non-eductor reactors.

An important aspect of the present invention is that the adiabatic stoichiometric flame temperature of high hydrogen content fuels can be reduced sufficiently to allow ultra low NOx diffusion flame combustion, even for the highest inlet temperature gas turbines thus allowing wide turndown. As shown in FIG. 6 for combustion of forty-two percent hydrogen fuel gas, use of an eductor reduces $NO_x$ emissions to well below two ppm as compared to over three ppm at base load without the eductor. With the need for carbon dioxide sequestration becoming of increasing importance, the art has turned to carbon-free hydrogen such as can be produced from syngas.

While the present invention has been described in considerable detail, other configurations exhibiting the characteristics taught herein for direct injection for low NOx combustion of fuels including natural gas as well as high hydrogen fuels are contemplated. For example, other catalytic reactor designs are contemplated as well as non-catalytic gas phase combustion. A portion of the fuel may also be injected upstream into air so as long as the stoichiometric condition of the resultant fuel/air mixture is below the autoignition limit. Therefore, the spirit and scope of the invention should not be limited to the description of the preferred embodiments described herein.

The invention claimed is:

1. A method for low NOx combustion comprising:

a) injecting a flow of fuel into a reaction zone of a fuel-rich combustor via an eductor; wherein the eductor comprises at least one reaction air flow tube positioned inside a fuel distribution plenum bounded by a fuel distribution plate, the fuel distribution plate comprising at least one passage therethrough from an inlet at the plenum to an outlet into a fuel conversion region; each reaction air flow tube passing into a corresponding passage in the fuel distribution plate and terminating at a point recessed from the outlet of the passage, thereby producing a corresponding gap within the fuel distribution plate; the eductor functioning such that fuel flows through the fuel distribution plenum and through the gap(s) in the fuel distribution plate thereby drawing air and inducing an air flow through the at least one reaction air flow tube so as to inject fuel and air in parallel flow into an inlet of the fuel-rich combustor, so as to produce a fuel-rich mixture of fuel and air in situ in the reaction zone of the fuel-rich combustor;

b) reacting the fuel-rich mixture of fuel and air in the reaction zone of the fuel-rich combustor and producing partial reaction products plus heat;

c) transferring a portion of the heat to a cooling air stream thereby cooling the partial reaction products and heating the cooling air stream;

d) contacting the cooled partial reaction products with the heated cooling air stream in a fuel-lean combustor.

2. The method of claim 1 whereby increased injection of the fuel results in increased induction of the air flow.

3. The method of claim 1 whereby the fuel comprises hydrogen.

4. A reactor providing for in-situ mixing of fuel and air comprising:

a) a reactor having an interior surface and an exterior surface, an upstream end and a downstream end;

b) a header plate positioned at the reactor upstream end;

c) a fuel distribution plate positioned within the reactor downstream of the header plate and having a plurality of passages passing through the fuel distribution plate from an inlet to an outlet for distributing fuel from a fuel distribution plenum to a downstream fuel conversion region;

d) at least one reaction air flow path having a reaction air flow path interior surface and a reaction air flow path exterior surface, a reaction air flow path upstream end and a reaction air flow path downstream end, and wherein each reaction air flow path upstream end sealingly engages the header plate and each reaction air flow path downstream end terminates within a corresponding passage within the fuel distribution plate at a point recessed from the outlet of the passage, thereby producing a corresponding gap in the fuel distribution plate proximate to each reaction air flow path;

e) at least one cooling air flow path having a cooling air flow path interior surface and a cooling air flow path exterior surface, a cooling air flow path upstream end and a cooling air flow path downstream end, and wherein each cooling air flow path upstream end sealingly engages the header plate and each cooling air flow path downstream end passes sealingly through the fuel distribution plate and terminates downstream of the fuel distribution plate;

f) a fuel distribution plenum defined by the reactor interior surface, the header plate, each reaction air flow path exterior surface, each cooling air flow path exterior surface, and the fuel distribution plate; wherein each reaction air flow path downstream end and each gap in the fuel distribution plate are aligned to inject air and fuel, respectively, in parallel flow into an inlet of the fuel conversion region.

5. The reactor of claim 4 further comprising:

a) a reaction air flow path tube for defining each reaction air flow path in step (d);

b) a cooling air flow path tube for defining each cooling air flow path in step (e); and c) a fuel conversion region within the reactor downstream of the fuel distribution plate.

6. The reactor of claim 5 wherein a catalyst is coated on at least a portion of an exterior surface of at least one cooling air flow path tube within the fuel conversion region.

7. The reactor of claim 5 further comprising:

a) a plurality of reaction air flow path tubes in step (d); and b) a plurality of cooling air flow path tubes in step (e).

8. The reactor of claim 5 wherein each reaction air flow path tube downstream end defines a tapered configuration.

9. A method for fuel and air in-situ mixing within a reactor comprising:

a) providing a reactor defining a reactor upstream end and a reactor downstream end, the reactor further comprising a reactor housing defining a reactor housing interior surface and a reactor housing exterior surface;

b) providing a header plate positioned at the reactor upstream end;

c) providing a fuel distribution plate positioned within the reactor downstream of the header plate and having a plurality of passages passing through the fuel distribution plate from an inlet to an outlet for distributing fuel from a fuel distribution plenum to a downstream fuel conversion region;

d) providing at least one reaction air flow path wherein each reaction air flow path defines a reaction air flow path interior surface and a reaction air flow path exterior surface, a reaction air flow path upstream end and a reaction air flow path downstream end, and wherein each reaction air flow path upstream end sealingly engages the header plate and each reaction air flow path downstream end terminates within a corresponding passage in the fuel distribution plate at a point recessed from the outlet of the passage, thereby producing a corresponding gap in the fuel distribution plate proximate to each reaction air flow path; wherein each reaction air flow path downstream end and each gap in the fuel distribution plate are aligned to inject air and fuel, respectively, in parallel flow into an inlet of the fuel conversion region;

e) providing at least one cooling air flow path wherein each cooling air flow path defines a cooling air flow path interior surface and a cooling air flow path exterior surface, a cooling air flow path upstream end and a cooling air flow path downstream end, and wherein each cooling air flow path upstream end sealingly engages the header plate and each cooling air flow path downstream end passes sealingly through the fuel distribution plate and terminates downstream of the fuel distribution plate;

f) providing a fuel distribution plenum defined by the reactor interior surface, the header plate, each reaction air flow path exterior surface, each cooling air flow path exterior surface, and the fuel distribution plate;

g) providing a first air flow and passing the first air flow into each reaction air flow path at the reaction air flow path upstream end wherein the first air flow exits each reaction air flow path at the reaction air flow path downstream stream end;

h) providing a second air flow and passing the second air flow into each cooling air flow path at the cooling air flow path upstream end wherein the second air flow exits each cooling air flow path at the cooling air flow path downstream end;

i) passing a fuel into the fuel distribution plenum and through each gap in the fuel distribution plate; and j) sizing each gap in the fuel distribution plate to promote rapid mixing of the fuel and the first air flow exiting each reaction air flow path downstream end.

10. The method of claim 9 further comprising:

a) providing a reaction air flow path tube for defining each reaction air flow path in step (d) wherein each reaction air flow path tube defines a reaction air flow path tube interior surface and a reaction air flow path tube exterior surface, a reaction air flow path tube upstream end and a reaction air flow path tube downstream end, and wherein each reaction air flow path tube upstream end sealingly engages the header plate and each reaction air flow path tube downstream end terminates at a point recessed from the outlet of the corresponding passage in the fuel distribution plate;

b) providing a cooling air flow path tube for defining each cooling air flow path in step (e) wherein each cooling air flow path tube defines a cooling air flow path tube interior surface and a cooling air flow path tube exterior surface, a cooling air flow path tube upstream end and a cooling air flow path tube downstream end, and wherein each cooling air flow path tube upstream end sealingly engages the header plate and each cooling air flow path tube downstream end passes sealingly through the fuel distribution plate and terminates downstream of the fuel distribution plate; and c) providing a fuel conversion region within the reactor downstream of the fuel distribution plate wherein the fuel conversion region is defined by the reactor housing interior surface, the fuel distribution plate, each cooling air flow path tube exterior surface; and d) promoting fuel conversion within the fuel conversion region.

11. The method of claim 10 wherein a catalyst is coated on at least a portion of at least one cooling air flow path tube exterior surface within the fuel conversion region.

12. The method of claim 9 further comprising:

a) providing a plurality of reaction air flow paths in step (d); and b) providing a plurality of cooling air flow paths in step (e).

13. The method of claim 10 further comprising:

a) providing a plurality of reaction air flow path tubes in step (d); and b) providing a plurality of cooling air flow path tubes in step (e).

14. The method of claim 9 further comprising providing a third air flow and passing the third air flow over the reactor housing exterior surface.

15. The method of claim 10 further comprising providing a third air flow and passing the third air flow over the reactor housing exterior surface.

16. The method of claim 11 further comprising providing a third air flow and passing the third air flow over the reactor housing exterior surface.

17. The method of claim 10 wherein each reaction air flow path tube downstream end defines a tapered configuration.

18. The method of claim 10 wherein the step of promoting fuel conversion within the fuel conversion region further comprises:

a) reacting the fuel upon contact with the first air flow within the fuel conversion region producing partial reaction products plus heat;

b) promoting heat transfer from the fuel conversion region to each cooling air flow path tube, thereby cooling the partial reaction products and heating a cooling air flowing in each cooling air flow path tube; and c) reducing the stoichiometric flame temperature of the fuel thereby promoting low NOx diffusion flame combustion.

* * * * *